US011655006B2

(12) United States Patent
Sporing

(10) Patent No.: US 11,655,006 B2
(45) **Date of Patent: *May 23, 2023**

(54) PONTOON SYSTEMS AND METHODS

(71) Applicant: Lawrence Donald Sporing, Deer Park, OH (US)

(72) Inventor: Lawrence Donald Sporing, Deer Park, OH (US)

( * ) Notice: Subject to any disclaimer, the term of this patent is extended or adjusted under 35 U.S.C. 154(b) by 67 days.

This patent is subject to a terminal disclaimer.

(21) Appl. No.: 17/320,786

(22) Filed: May 14, 2021

(65) Prior Publication Data

US 2021/0269125 A1 Sep. 2, 2021

Related U.S. Application Data

(63) Continuation of application No. 16/419,930, filed on May 22, 2019, now Pat. No. 11,008,075, which is a continuation of application No. 16/039,157, filed on Jul. 18, 2018, now Pat. No. 10,300,994, which is a continuation of application No. 15/491,515, filed on Apr. 19, 2017, now Pat. No. 10,053,196.

(60) Provisional application No. 62/325,268, filed on Apr. 20, 2016.

(51) Int. Cl.

| | |
|---|---|
| ***B63B 35/38*** | (2006.01) |
| ***B63B 13/00*** | (2006.01) |
| ***B63B 1/12*** | (2006.01) |
| ***B63B 43/06*** | (2006.01) |

(52) U.S. Cl.

CPC ..... *B63B 35/38* (2013.01); *B63B 1/121* (2013.01); *B63B 13/00* (2013.01); *B63B 43/06* (2013.01); *B63B 2207/02* (2013.01)

(58) Field of Classification Search

CPC ..... B63B 35/38; B63B 1/121; B63B 13/00; B63B 43/06; B63B 2207/02

See application file for complete search history.

(56) References Cited

U.S. PATENT DOCUMENTS

| | | | | |
|---|---|---|---|---|
| 4,763,592 | A | 8/1988 | Russ | |
| 4,782,778 | A | 11/1988 | Barbaglia | |
| 5,397,000 | A * | 3/1995 | Holte | B65D 81/052 206/545 |
| 7,421,963 | B1 | 9/2008 | Victor | |
| 8,215,254 | B2 | 7/2012 | Pavlow et al. | |
| 9,045,200 | B1 | 6/2015 | Chaney | |
| 10,053,196 | B2 * | 8/2018 | Sporing | B63B 35/38 |
| 10,300,994 | B2 * | 5/2019 | Sporing | B63B 1/121 |
| 11,008,075 | B2 * | 5/2021 | Sporing | B63B 1/121 |
| 2002/0129756 | A1 | 9/2002 | Myers | |

(Continued)

*Primary Examiner* — Stephen P Avila
(74) *Attorney, Agent, or Firm* — Ulmer & Berne LLP; Vance V. Van Drake, III

(57) ABSTRACT

Embodiments include a retrofit pontoon system including a pontoon, the pontoon having a pontoon body defining a first cavity, the pontoon body having a first aperture; a retrofit assembly, the retrofit assembly including a selectively fillable container sized to pass through the first aperture; and a pump. The pump is operably coupled with the selectively fillable container such that operation of the pump selectively fills and drains water from the selectively fillable container, wherein filling the selectively fillable container lowers the profile of the pontoon in the water and emptying the selectively fillable container raises the profile of the pontoon in the water.

20 Claims, 13 Drawing Sheets

(56) References Cited

U.S. PATENT DOCUMENTS

| | | | |
|---|---|---|---|
| 2003/0106478 | A1 | 6/2003 | Mears et al. |
| 2009/0314354 | A1 | 12/2009 | Chaffee |
| 2011/0146554 | A1 | 6/2011 | Wright et al. |

* cited by examiner

PONTOON SYSTEMS AND METHODS

REFERENCE TO RELATED APPLICATION

The present application is a continuation of U.S. patent application Ser. No. 16/419,930, filed May 22, 2019, which is a continuation of U.S. patent application Ser. No. 16/039,157, filed Jul. 18, 2018, now U.S. Pat. No. 10,300,994, issued May 28, 2019, which is a continuation of U.S. patent application Ser. No. 15/491,515, filed Apr. 19, 2017, now U.S. Pat. No. 10,053,196, issued Aug. 21, 2018, which claims priority to U.S. Provisional Patent Application No. 62/325,268, filed Apr. 20, 2016, which are incorporated by reference herein in their entireties.

TECHNICAL FIELD

Embodiments of the technology relate, in general, to pontoon technology, and, in particular, to selectively fillable pontoons for boats.

BRIEF DESCRIPTION OF THE DRAWINGS

The present disclosure will be more readily understood from a detailed description of some example embodiments taken in conjunction with the following figures.

DETAILED DESCRIPTION

Figure 1:
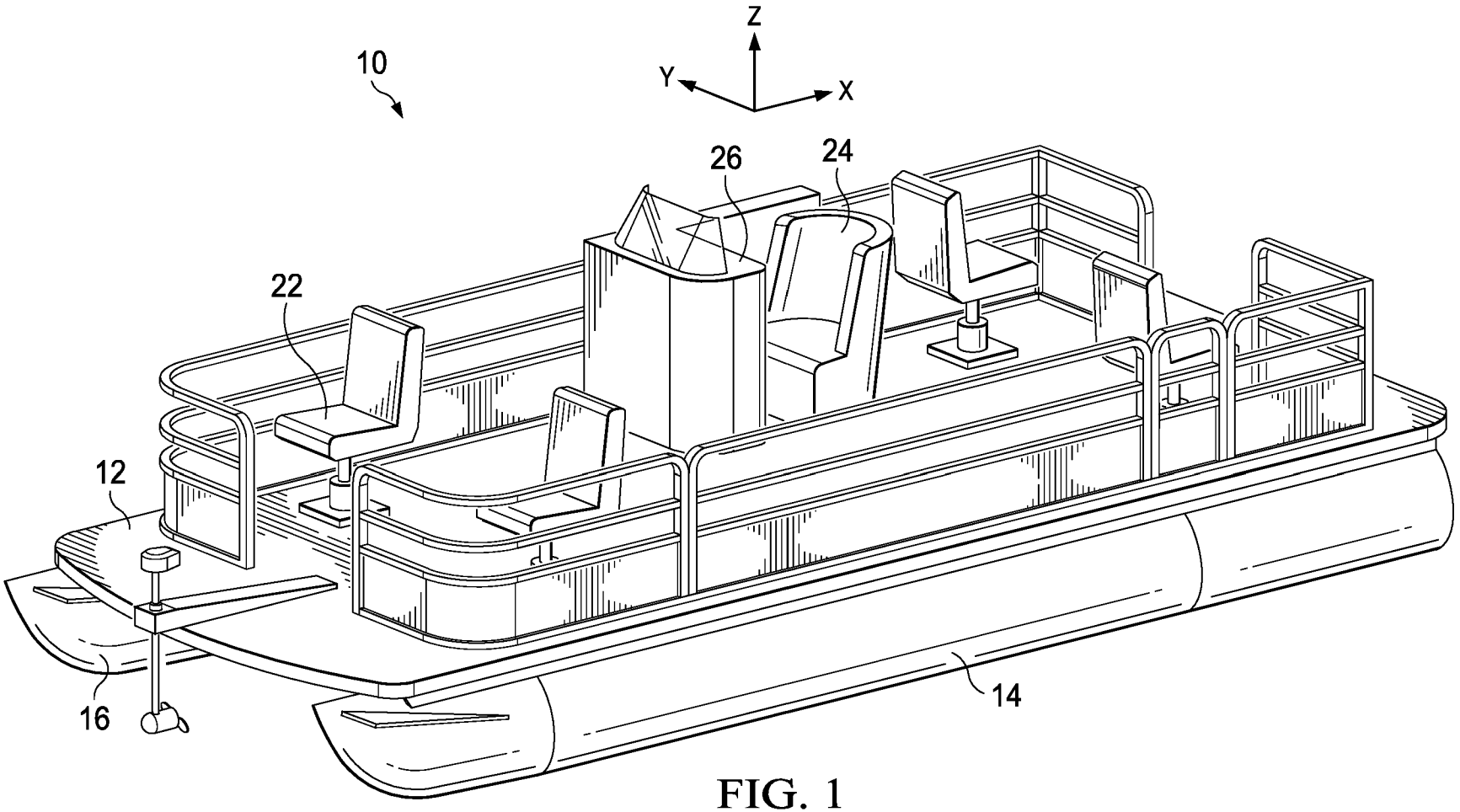
FIG. 1 is a perspective view of a pontoon boat according to one embodiment.

Various non-limiting embodiments of the present disclosure will now be described to provide an overall understanding of the principles of the structure, function, and use of the apparatuses, systems, methods, and processes disclosed herein. One or more examples of these non-limiting embodiments are illustrated in the accompanying drawings. Those of ordinary skill in the art will understand that systems and methods specifically described herein and illustrated in the accompanying drawings are non-limiting embodiments. The features illustrated or described in connection with one non-limiting embodiment may be combined with the features of other non-limiting embodiments. Such modifications and variations are intended to be included within the scope of the present disclosure.

Reference throughout the specification to "various embodiments," "some embodiments," "one embodiment," "some example embodiments," "one example embodiment," or "an embodiment" means that a particular feature, structure, or characteristic described in connection with any embodiment is included in at least one embodiment. Thus, appearances of the phrases "in various embodiments," "in some embodiments," "in one embodiment," "some example embodiments," "one example embodiment," or "in an embodiment" in places throughout the specification are not necessarily all referring to the same embodiment. Furthermore, the particular features, structures or characteristics may be combined in any suitable manner in one or more embodiments.

Described herein are example embodiments of apparatuses, systems, and methods for adjustable pontoons for boats, docks, and the like. In one example embodiment, a pontoon boat can include one or a plurality of pontoons that can be selectively filled and drained with fluid to adjust the boat's position in the water. In some embodiments, the selectively fillable pontoons can be adjusted or controlled automatically with a controller or computer. In some embodiments, the pontoons can be divided into sections that can be independently filled or drained to create different boat positions within the water.

The examples discussed herein are examples only and are provided to assist in the explanation of the apparatuses, devices, systems and methods described herein. None of the features or components shown in the drawings or discussed below should be taken as mandatory for any specific implementation of any of these the apparatuses, devices, systems or methods unless specifically designated as mandatory. For ease of reading and clarity, certain components, modules, or methods may be described solely in connection with a specific figure. Any failure to specifically describe a combination or sub-combination of components should not be understood as an indication that any combination or sub-combination is not possible. Also, for any methods described, regardless of whether the method is described in conjunction with a flow diagram, it should be understood that unless otherwise specified or required by context, any explicit or implicit ordering of steps performed in the execution of a method does not imply that those steps must be performed in the order presented but instead may be performed in a different order or in parallel.

Example embodiments described herein can include providing a pontoon boat with the ability to adjust positon relative to the waterline to improve fishing quality. For example, in certain circumstances, a low profile boat may be advantageous for fishing, where a higher profile boat may be advantageous for travelling between fishing locations. Additionally, or alternatively, the pontoons can be equipped with any suitable features including lights, audible features, depth sensors, emergency filling systems, and the like.

As will be described in more detail with respect to FIG. 8, a pontoon management computer system or controller 50 in accordance with the present disclosure can be accessed via any suitable technique, such as a web-browser such as SAFARI, OPERA, GOOGLE CHROME, INTERNET EXPLORER, or the like executing on a client device. In some embodiments, the systems and methods described herein can be a web-based application or a stand-alone executable. Additionally, in some embodiments, the systems and methods described herein can integrate with various types of on-board computer systems, such as computer systems integrated with a fishing boat, and the like. Any suitable client device can be used to access, or execute, the pontoon management computing system, such as laptop computers, desktop computers, smart phones, tablet computers, and the like.

Figure 2:
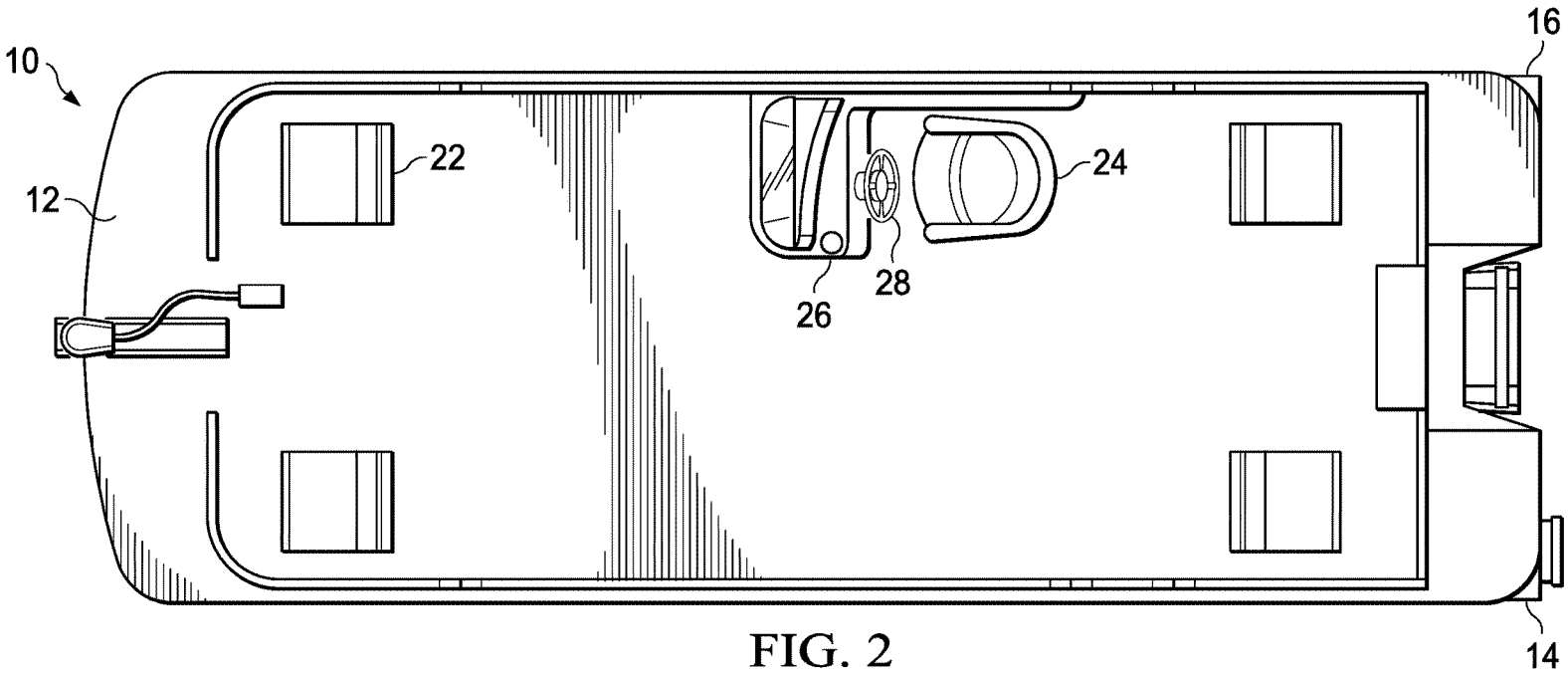
FIG. 2 is a top view of the pontoon boat shown in FIG. 1.
Figure 3:
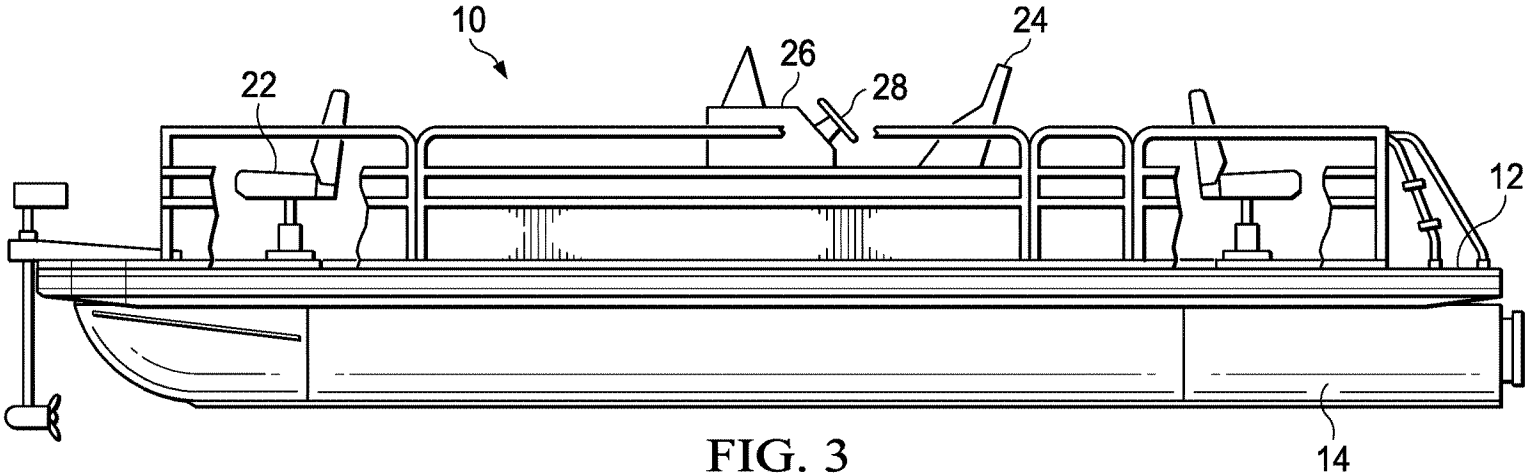
FIG. 3 is a right side view of the pontoon boat shown in FIG. 1.
Figure 5:
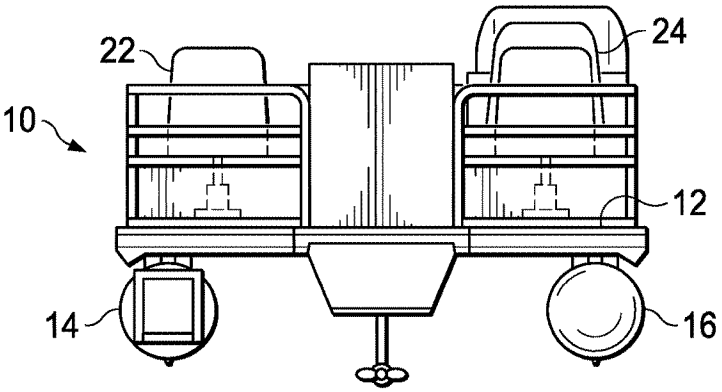
FIG. 5 depicts a rear view of the pontoon boat shown in FIG. 1.
Figure 4:
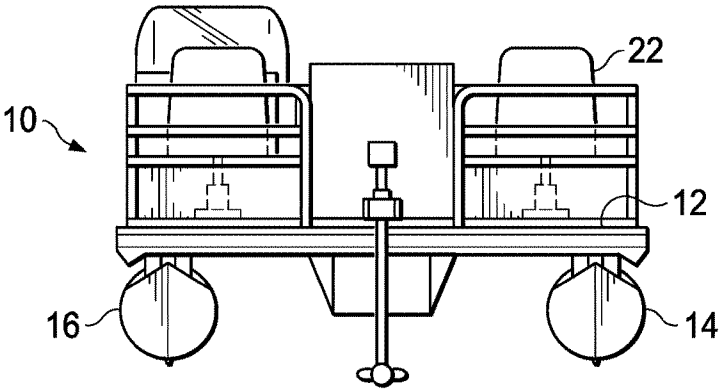
FIG. 4 depicts a front view of the pontoon boat shown in FIG. 1.
Figure 6:
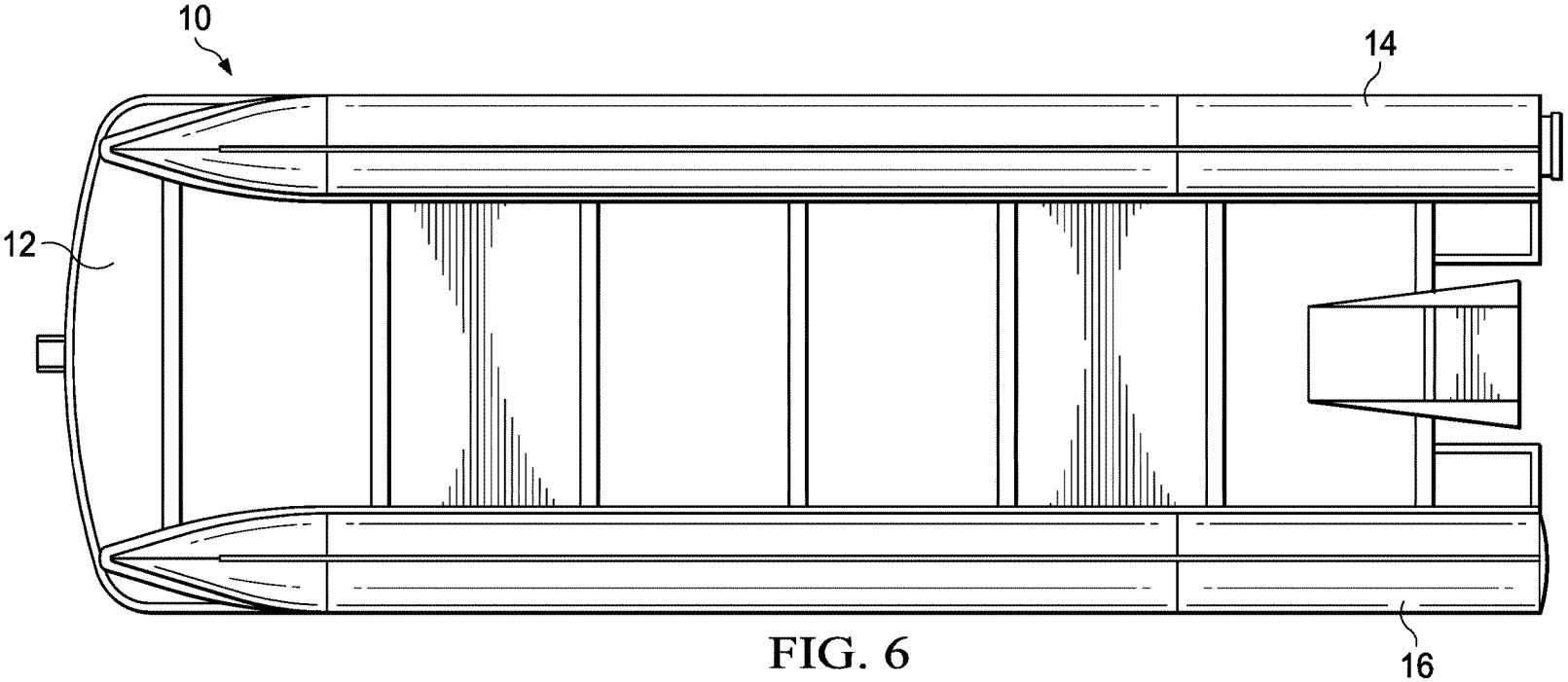
FIG. 6 depicts a bottom view of the pontoon boat shown in FIG. 1.
Figure 7:
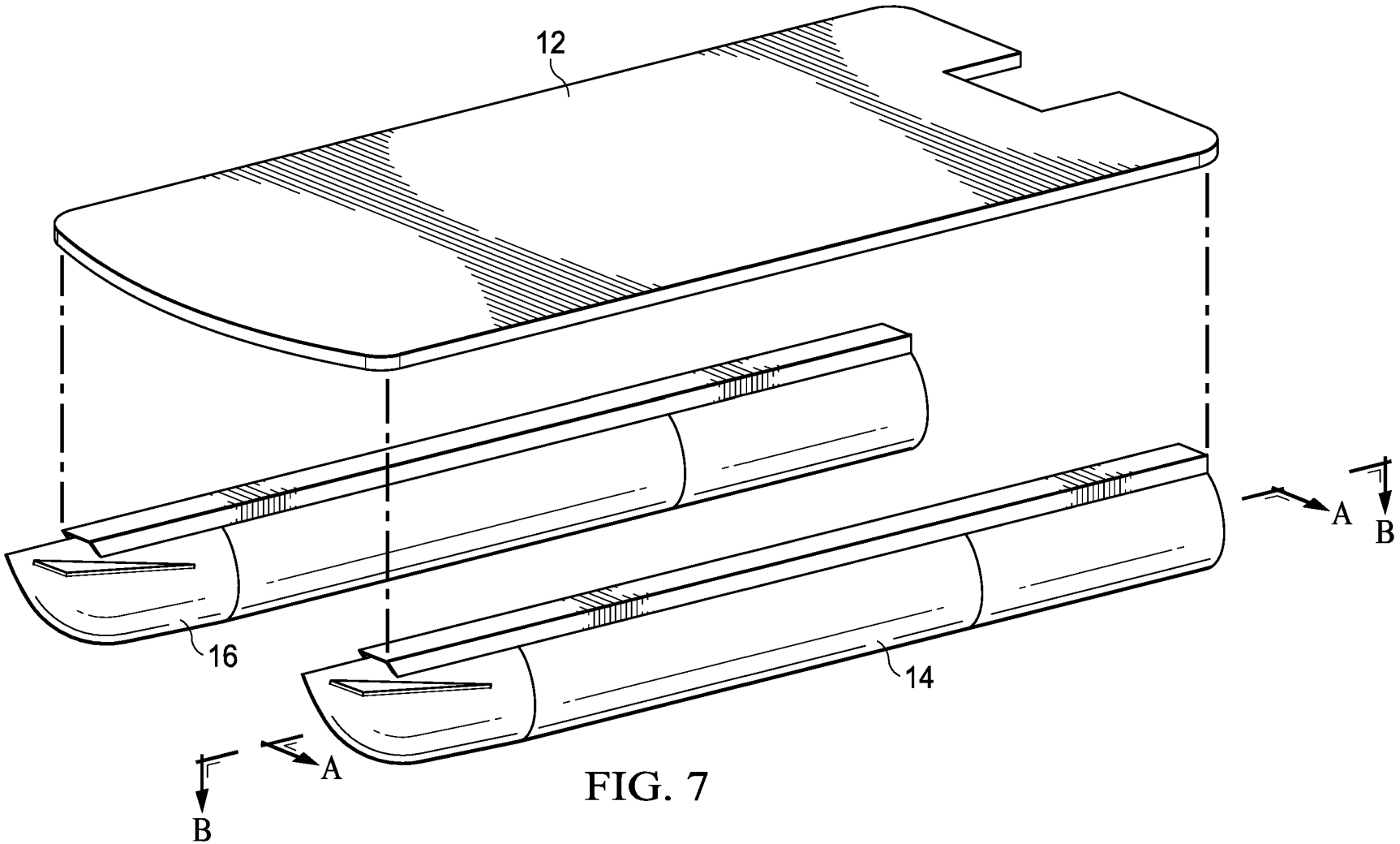
FIG. 7 depicts a partial exploded perspective view of the pontoon boat shown in FIG. 1.

Systems and methods described herein may generally provide an optimized fishing environment for users (e.g., a high profile boat positon during travel and a low profile boat position during fishing) to substantially optimize the fishing or boating experience for a user. Interaction with the controller 50 may include, without limitation, keyboard entry, writing from pen, stylus, finger, or the like, with a computer mouse, or other forms of input (voice recognition, etc.). It will be appreciated that the controller 50 can be associated with a dedicated display 26 (FIG. 2) on the dashboard of a boat or other vehicle. The display may be presented on a tablet, desktop, phone, board, or paper.

Referring now to FIGS. 1-7, various views of an example pontoon boat 10 are illustrated. It will be appreciated that any suitable pontoon boat or watercraft is contemplated, where pontoon boat 10 is shown by way of example only. The pontoon boat 10 can include a platform 12 that can be coupled with a first pontoon 14 and a second pontoon 16. The pontoons 14, 16 can be fixedly coupled to the bottom of the platform 12, can be substantially parallel, and can be spaced apart any suitable distance. The pontoons 14, 16 (FIG. 3) can have any suitable length 18 including from about 8 feet to about 14 feet, from about 10 feet to about 16 feet, from about 3 feet to about 8 feet, or any other suitable length. The pontoons 14, 16 can have any suitable diameter 20 including from about 12 inches to about 24 inches, from about 18 inches to about 30 inches, or at about 24 inches. In the example illustrated in FIGS. 1-7, the pontoon boat 10 includes two spaced-apart pontoons, but it will be appreciated that any suitable number of pontoons having any orientation is contemplated. In an alternate embodiment, a series of small pontoons can be used in place of the two long pontoons to provide even greater control or flexibility in accordance with embodiments described herein. The pontoons 14, 16 can be streamlined and have a varying diameter to improve fluid dynamics, or the pontoons can have a substantially uniform diameter for applications such as for use in docks. The pontoons 14, 16 can be constructed from any suitable material such as aluminum. The pontoon boat 10 can include seating 22, a captain's chair 24, a dashboard 26, a steering wheel 28, and/or any other suitable features. The pontoon boat 10 can include any suitable fishing gear such as a fish finder, radar, well, trolling motor, or the like.

Figure 8A:
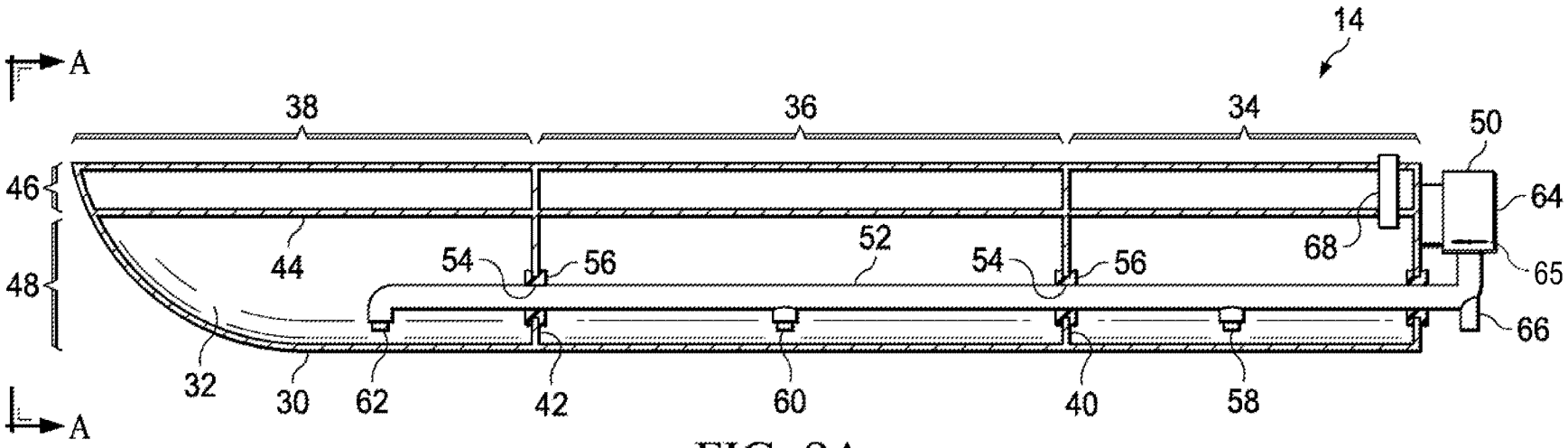
FIG. 8A depicts a right side cross-sectional view of a pontoon according to one embodiment.

FIG. 8A depicts a cross-sectional view taken along reference plane A-A (FIG. 7) of the pontoon 14 according to one embodiment. In the illustrated example, the pontoon 14 can include a substantially bullet-shaped or cigar-shaped pontoon body 30. The pontoon body 30 can be configured from aluminum and can define an internal cavity 32. The pontoon 14 can be divided into a first section 34, a second section 36, and a third section 38 by a first bulkhead 40 and a second bulkhead 42. The pontoon body 14 can include a horizontal divider 44 that can further divide the pontoon body into an upper section 46 and a lower section 48. The bulkheads 40, 42 and horizontal divider 44 can be constructed from aluminum and can be welded or otherwise coupled with the pontoon body 30 to form a watertight seal. In one embodiment, the upper section 46 of the pontoon 14 is never filled with water such that a minimum level of buoyancy is maintained in the pontoon 14 even when the lower section 48 of the pontoon is completely or partially filled. The horizontal divider 44 may substantially and permanently separate the upper section 46 from the lower section 48 such that only the lower section 48 can be selectively filled with fluid to adjust the position of the pontoon boat 10 relative to the waterline. Similarly, the first bulkhead 40 and the second bulkhead 42 can substantially separate first section 34, second section 36, and third section 38 such that fluid can only fill or drain from the sections via dedicated tubing in accordance with versions described herein. It will be appreciated that in certain embodiments, particularly embodiments with relatively large pontoons, an upper section 46 may not be provided such that the entire pontoon is fillable.

Still referring to FIG. 8A, in one embodiment the pontoon 14 can include a pipe or main tube 52 that can extend substantially horizontally through the first section 34, the second section 36, and into the third section 38. The main tube 52 can pass through apertures 54 defined by the first bulkhead 40 and the second bulkhead 42. The bulkheads 40, 42 can include a seal 56 or the like that can create a watertight seal between the main tube 52 and the bulkheads 40, 42. In one embodiment, the main tube is constructed from PVC and has a diameter of about 1 inch. The main tube can include a first lateral tube 58, a second lateral tube 60, and a third lateral tube 62 that can be associated with the first section 34, the second section 36, and the third section 38, respectively. The lateral tubes 58, 60, 62 can branch off of the main tube 52 into each respective section such that fluid can be selectively added or removed from each section 34, 36, 38 during operation. It will be appreciated that the lateral tubes 58, 60, 62 can extend any length, but in one embodiment are sufficiently long or otherwise configured to drain water that may pool in the bottom of each section.

The pontoon 14 can include a pump 64 that can be coupled to the rear end of the pontoon 14. The pump 64 can be any suitable pump that can have a first fill mode and a second drain mode, for example. The pump 64 can be coupled with an inlet/outlet tube 66 that can be sized and positioned to remain in the water throughout the operation of the pump 64. The pump 64 can draw water with an impeller 65 through the inlet/outlet tube 66 and can urge the water through the main tube 52 and the associated lateral tubes 58, 60, 62 such that the water begins to fill the sections 34, 36, and 38 of the pontoon 14. In the drain mode, the pump 64 can reverse direction of the impeller and can draw water through the lateral tubes 58, 60, and 62 into the main tube 52 such that the water can be expelled through the inlet/outline tube 66. The pump 64 can be controlled manually or, alternatively, can be controlled by the controller 50. The pump 64 may be battery operated, solar powered, or have any other suitable power source. It will be appreciated that as water or fluid is added to the pontoons 14, 16 the pontoon boat 10 can sink lower into the water and as water or fluid is removed from the pontoon 14, 16 the pontoon boat 10 can rise higher in the water.

During operation of the pontoon boat 10, the pontoons 14, 16 can be selectively filled or emptied as desired. For example, when boating at normal speed it may be preferable that the pontoons 14, 16 be substantially free of water inside the pontoon body 30. Added water may increase drag and unnecessarily slow down the pontoon boat 10. When the pontoon boat 10 has stopped, such as at a desirable fishing location, it may be advantageous for the pontoon boat 10 to have a relatively lower profile relative to the waterline. Such a lower profile can make it easier to access fish, to remain stable in the water, to be less susceptible to wind, etc. Once a desirable location has been reached the pump 64 can be activated to draw water through the inlet/outlet tube 66 and into the main tube 52. Water from the main tube 52 can pass through the lateral tubes 58, 60, 62 into the sections 34, 36, 38, respectively. As the sections 34, 36, 38 begin to fill the pontoons 14, 16 can begin to sit lower and lower in the water. The operator can manually operate the pump 64 until the desirable depth is set or, alternatively, the controller 50 can guide the pump 64 to fill the pontoon 14 to a specific or pre-set level.

In an alternate embodiment, the lateral tubes 58, 60, 62 can include valves (not shown) that can be opened and closed manually, with a controller 50, via wiring to the dashboard 26 (FIG. 1), or the like. In this embodiment the fluid or water may be pumped through the main tube 52, but valves associated with certain sections may be opened and/or closed depending upon the desired profile. Such a configuration may allow one or more sections 34, 36, 38 to be selectively filled to adjust the position of the boat in the water on two or three axes. For example, referring to FIG. 1, a coordinate system is showing having X, Y, and Z axes. The pontoon boat 10 can, for example, rotate at the origin above the X axes, Y axes, and/or Z axis until a desirable position in the water is achieved. In one example, the pontoons may be filled such that the pontoon boat only rotates about the X axes. In an alternate example the same pontoon boat may be rotated only about the Y axes. It will be appreciated that the pontoon boat 10 can be aligned along any suitable plane in the coordinate system. It will be appreciated that any suitable degree of rotation about one or more of the axes is contemplated including from about 1 degree to about 15 degrees, from about 5 degrees to about 10 degrees, from about 2 degrees to about 5 degrees, from about one degree to about five degrees, greater than about one degree, or combinations thereof. For example, the pontoon boat 10 may have a 2 degree rotation about a first axis and a five degree rotation about a second axis.

In one embodiment, each pontoon 14, 16 can be associated with a separate pump 64 or, as will be described herein, a single pump can be used for both pontoons 14, 16. It will be appreciated that the position of the pump 64 is shown by way of example only and any suitable placement and configuration is contemplated. It will be appreciated that operation of the pump 64 can be controlled on the pump itself, through wiring (not shown) to the dashboard 26 (FIG. 1) of the pontoon boat, wirelessly to the dashboard 26, by a mobile or computer device, or by any other suitable method or mechanism. In one embodiment the main tube 52 can include a shutoff valve (not shown) that can be closed in an emergency or equipment malfunction to prevent water from filling the pontoons 14, 16.

In one embodiment, the pontoon 14 can include a port 68 that can be used for the selective delivery of fluid, chemicals, cleaners, or the like into the internal cavity 32 of the pontoon body 30. For example, if lake water is being used to selectively fill the pontoon 14 then algae or other biological material may begin to grow within the pontoon body 30. One or more ports 68 may provide access to the internal cavity 32 for the delivery of biocide, algaecide, pesticide, or cleaning materials. The port 68 can allow for a hose (not shown) to be inserted into the internal cavity 32 to deliver or remove fluid as desirable. It will be appreciated that each section of the internal cavity 32 can be associated with a separate port or the port system can be coupled with each independent section of the pontoon. The pontoon body 30 can also include non-stick or algae-resistant paint, for example, to resist the attachment of plants, animals, organisms, or the like.

Figure 8B:
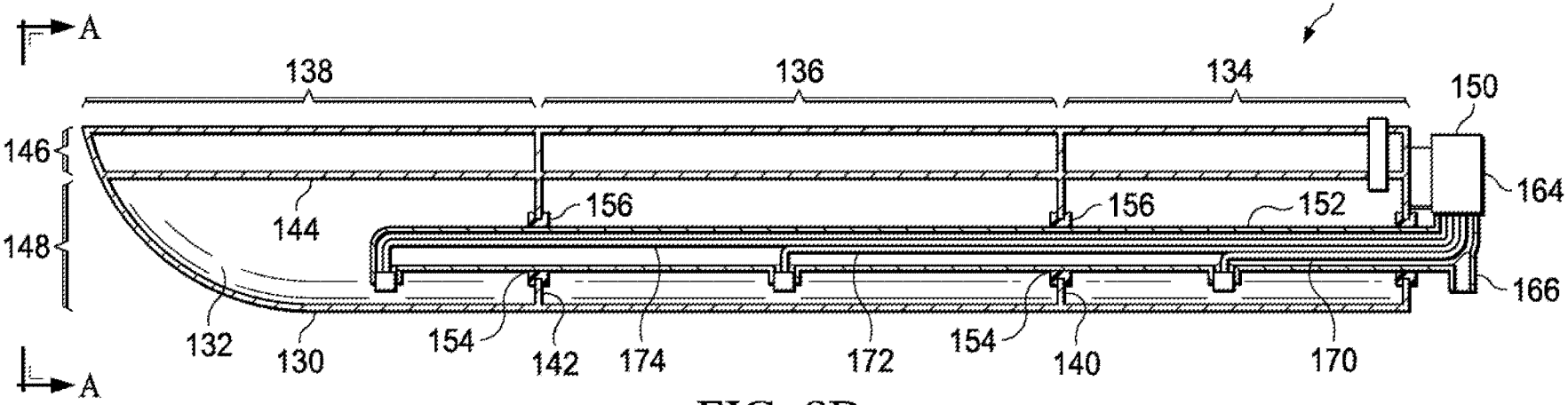
FIG. 8B depicts a right side cross-sectional view of a pontoon according to an alternate embodiment.

Referring to FIG. 8B, an alternate embodiment of a pontoon 114 is shown. The pontoon body 130 can be constructed from aluminum and can define an internal cavity 132. The pontoon 114 can be divided into a first section 134, a second section 136, and a third section 138 by a first bulkhead 140 and a second bulkhead 142. The pontoon body 114 can include a horizontal divider 144 that can further divide the pontoon body into an upper section 146 and a lower section 148. In one embodiment, the upper section 146 of the pontoon 114 is never filled with water such that a minimum level of buoyancy is maintained in the pontoon 114 even when the lower section 148 of the pontoon is completely or partially filled. The horizontal divider 144 may substantially and permanently separate the upper section 146 from the lower section 148 such that only the lower section 148 can be selectively filled with fluid to adjust the position of the pontoon boat 10 (FIG. 1) relative to the waterline. Similarly, the first bulkhead 140 and the second bulkhead 142 can substantially separate first section 134, second section 136, and third section 138 such that fluid can only fill or drain from the sections via dedicated tubing in accordance with versions described herein.

Still referring to FIG. 8B, in one embodiment the pontoon 114 can include a pipe or main tube 152 that can extend substantially horizontally through the first section 134, the second section 136, and into the third section 138. The main tube 152 can pass through apertures 154 defined by the first bulkhead 140 and the second bulkhead 142. The bulkheads 140, 142 can include a seal 156 or the like that can create a watertight seal between the main tube 152 and the bulkheads 140, 142. In one embodiment, the main tube is constructed from PVC and has a diameter of about 2 inches. The main tube can include a first lateral projection 158, a second lateral projection 160, and a third lateral projection 162 that can be associated with the first section 134, the second section 136, and the third section 138, respectively. The lateral projections 158, 160, 162 can branch off of the main tube 152 into each respective section 134, 136, 138 during operation.

The pontoon 114 can include a pump 164 that can be coupled to the rear end of the pontoon 114. The pump 164 can be any suitable pump that can have a first fill mode and a second drain mode. The pump 164 can be coupled with an inlet/outlet tube 166 that can be sized and positioned to remain in the water throughout the operation of the pump 164. The pump 164 can be coupled with separate tubes 170, 172, 174 that can pass through the main tube 152 such that each of sections 134, 136, 138 can be filled independently. The pump 164 can draw water through the inlet/outlet tube 166 and can urge the water through one or more of the tubes 170, 172, 174 to selectively fill the sections 134, 136, and 138 of the pontoon 114. In the drain mode, the pump 164 can reverse direction and can draw water through one or more of the tubes 170, 172, 174 such that the water can be expelled through the inlet/outline tube 166. The pump 164 can be controlled manually or, alternatively, can be controlled by the controller 150. In the illustrated embodiment, it is possible for the user to adjust the amount of fluid within each section of the pontoon 114 to create different positions for the pontoon boat 10 (FIG. 1) within the water. As will be described in more detail herein, it may be advantage in certain situations for the bow of the pontoon boat 10 to be filled when the stern of the boat is relatively empty, or vice versa. Similarly, it may be advantageous in certain situations to have one pontoon filled to a certain level or fill profile while another pontoon has a different fill profile.

Figure 9:
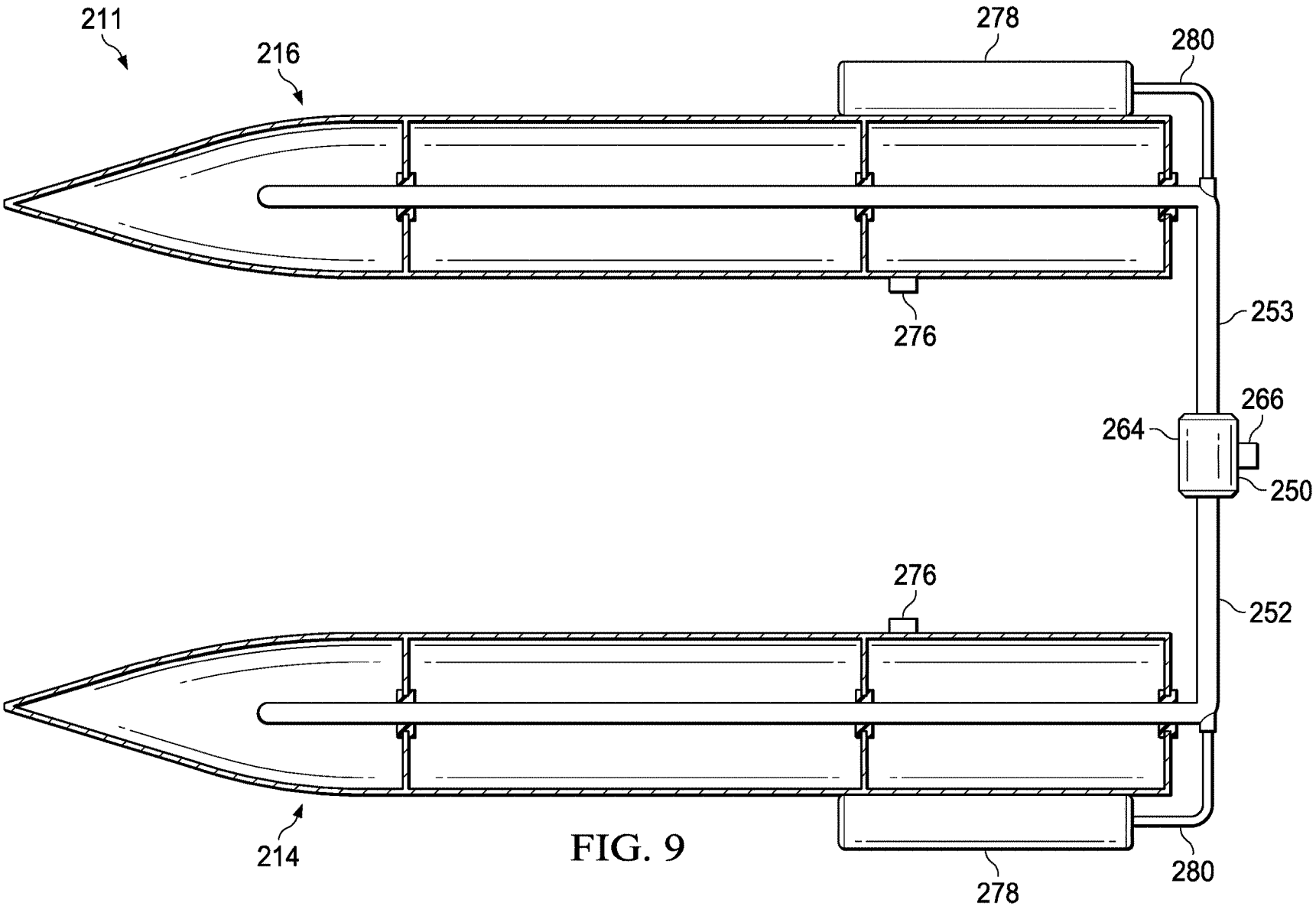
FIG. 9 depicts a top cross-sectional view of a pontoon assembly according to one embodiment.

Referring to FIG. 9, a top view of one embodiment of a selectively fillable pontoon system 211 is shown. The selectively fillable pontoon system 211 can include a first pontoon 214 and a second pontoon 216 that can be coupled to a pump 264 via a first tube 252 and a second tube 253, respectively. The pump 264 can be associated with an inlet/outlet tube 266 that can be used to draw or drain water for the pontoon system 211. In the illustrated embodiment, the pump 264 can substantially fill or drain the pontoons 214, 216 at the same time and at substantially the same level. In one embodiment, the pontoon system 211 can include depth sensors 276 that can be used to determine the fill profile and position of the pontoons 214, 216 in the water. Information gathered by the depth sensors 276 can be processed automatically by a controller 250 associated with the pump 264 to maintain a particular position for the pontoon boat 10 (FIG. 1) in the waterline, for example. The controller 250 can be preprogrammed with one or a plurality of fill profiles associated with a specific depth, where the controller 250 can fill or drain the pontoons 214, 216 until a desired profile is achieved.

In one embodiment, the pontoons 214, 216 can be associated with one or more air tanks 278 via a hose 280 coupled with the tubes 252, 253 to provide immediate buoyancy to the pontoons 214, 216 in the event of a breach or emergency. The air tanks can be filled with compressed gas, such as carbon dioxide gas, where upon a breach occurring in a pontoon the compressed gas can be delivered through the tubes 252, 253 to expel water or fluid from the pontoons 214, 216. The tanks 278 can be manual or can be associated with the controller 250 to initiate upon detection of a leak in one or more of the pontoons 214, 216. In one embodiment, the depth sensors 276 can be monitored by the controller 250 to alter the delivery of compressed gas to the pontoon(s) during a breach to maintain a substantially balanced profile. It will be appreciated that tanks 278 can be filled with any suitable material such as foam or the like that could help provide a seal and/or buoyancy for the pontoons 214, 216.

Figure 10:
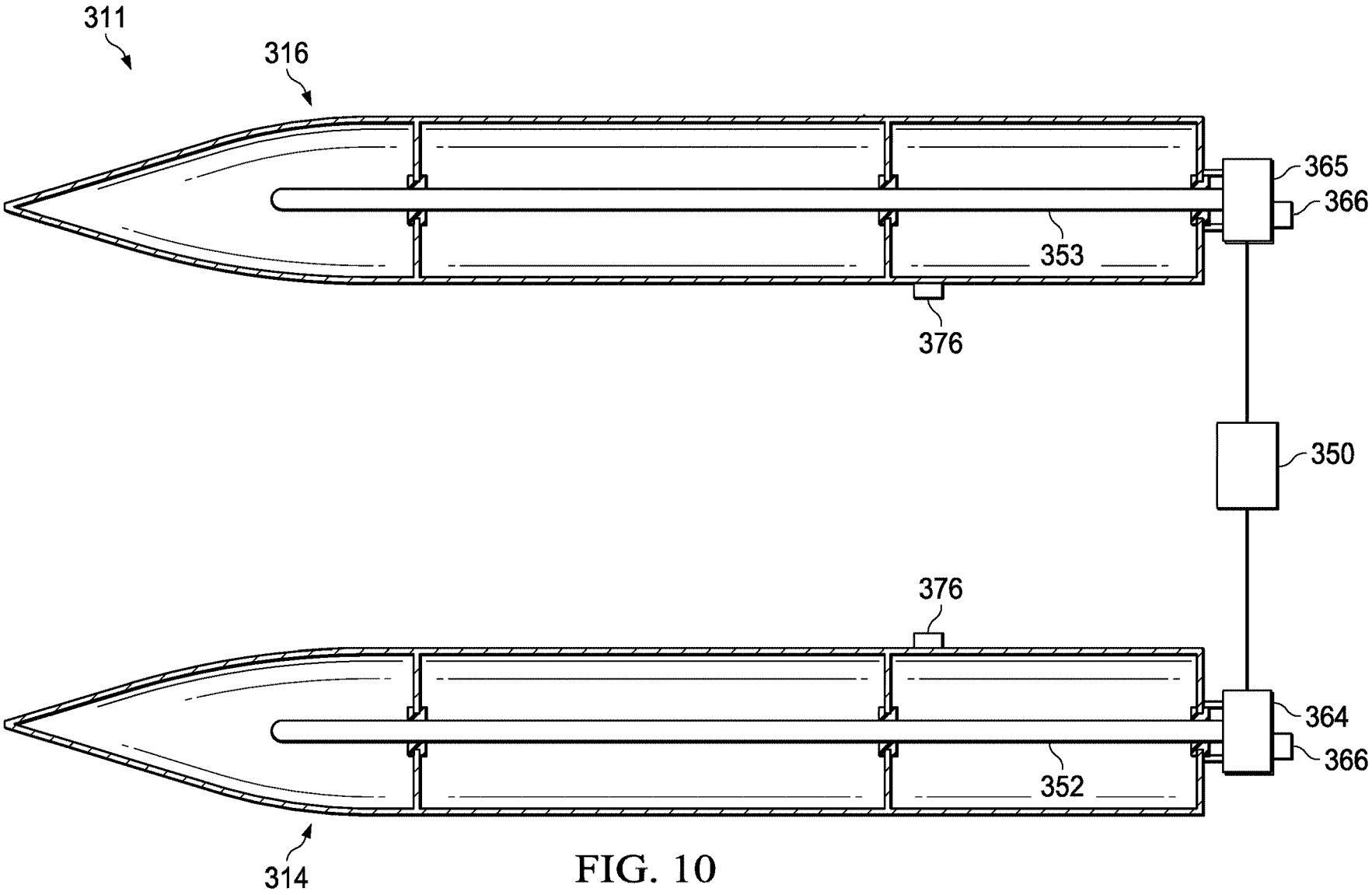
FIG. 10 depicts a top cross-sectional view of a pontoon assembly according to an alternate embodiment.

Referring to FIG. 10, a top view of one embodiment of a selectively fillable pontoon system 311 is shown. The selectively fillable pontoon system 311 can include a first pontoon 314 coupled with a first pump 364 via a first tube 352 and a second pontoon 316 that can be coupled to a second pump 365 via a second tube 353. The pumps 364, 365 can be associated with one or a plurality of inlet/outlet tubes 366 that can be used to draw or drain water for the pontoon system 311. In the illustrated embodiment, the pumps 364, 365 can substantially fill or drain the pontoons 314, 316 independently to create different fill profiles and positions for the pontoon boat 10 (FIGS. 15-18, for example). In one embodiment, the pontoon system 311 can include depth sensors 376 that can be used to determine the fill profile and position of the pontoons 314, 316 in the water. Information gathered by the depth sensors 376 can be processed automatically by a controller 350 associated with the pumps 364, 365 to maintain a particular position for the pontoon boat 10 in the waterline, for example. The controller 350 can be preprogrammed with one or a plurality of fill profiles associated with a specific depth, where the controller 350 can fill or drain the pontoons 314, 316 until a desired profile is achieved. In the illustrated embodiment, the controller can be associated with profiles that fill the pontoons 314, 316 differently to create asymmetrical or varied positions within the water. Alternatively, the user can manually adjust the pumps 364, 365 to achieve a desired position or profile.

Figure 11A:
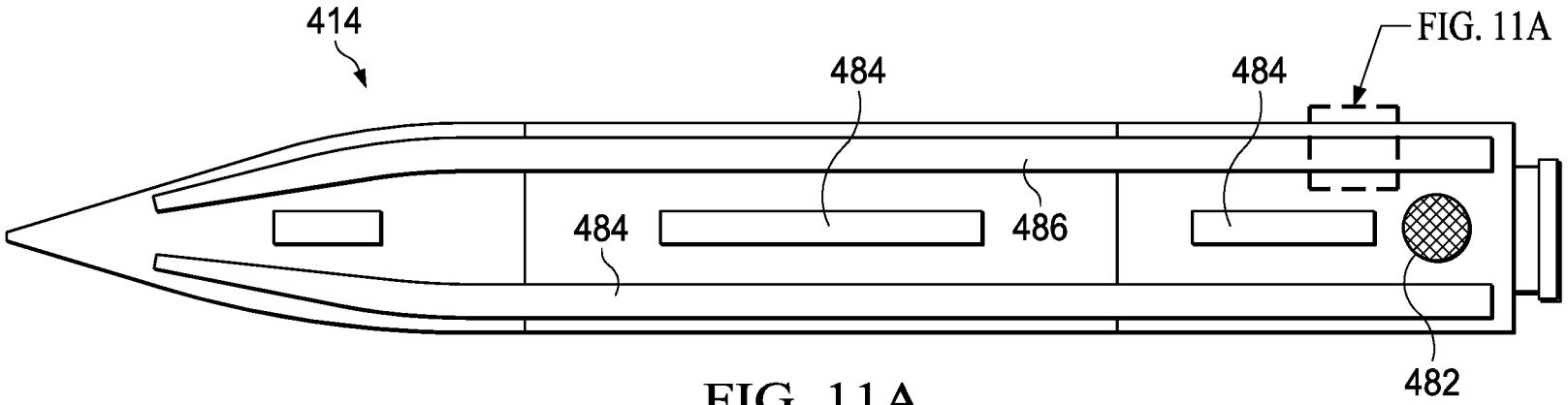
FIG. 11A depicts a bottom view of a pontoon having a visual, auditory, and vibratory system according to one embodiment.
Figure 11B:
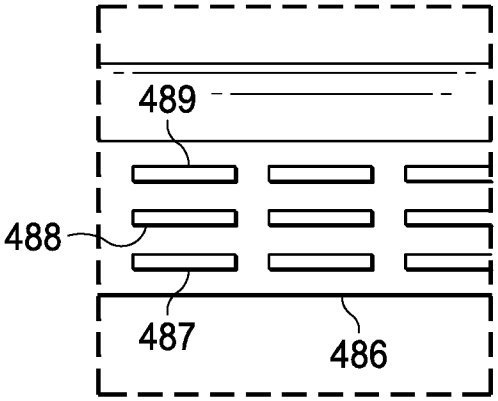
FIG. 11B depicts a more detailed view of the visual system shown in FIG. 11A according to one embodiment.

Referring to FIGS. 11A and 11B, one embodiment of a pontoon 414 is shown having a plurality of displays, indicators, features, or the like. The pontoon 414 can include one or a plurality of speakers 482, alarms, or auditory systems that can be used for any suitable purpose. For example, certain auditory profiles, such as a fish distress signal, delivered under the water may particularly attractive to certain types of fish or aquatic life. The pontoon 414 can include one or a plurality of haptic or vibratory systems 484 that can send vibrations through the water. The pontoon 414 can include a first light strip 484 and a second light strip 486 that can extend substantially the length of the pontoon 414. The light strips 484, 486 can be comprised of a first row 487 of ultraviolet or black lights, a second row 488 of red lights, and a third row 489 of white lights. It will be appreciated that any suitable light arrangement and type is contemplated, but the ultraviolet light, red lights, and/or white light may be attractive to aquatic life or provide good visibility during fishing activities. Red light may be low spectrum and reduce the number of insects that are attracted. The light strips 484, 486 can be flush mounted with the pontoon 414, can be adhered or otherwise attached to the pontoon 414, or can be selectively removable. The light strips 484, 486 can include fiber optics, light emitting diodes, or any other suitable lighting system or mechanism. The light strips 484, 486 and other accessories can be associated with a controller (not shown) such that certain lighting profiles can be preprogrammed for different uses. For example, a particular fish species may have a specific visual, auditory, and haptic profile that can be programmed to best attract that specific type of fish. Control of the accessories can be associated with the dashboard of the pontoon boat 10 or, alternatively, can be associated with a remote device such as a mobile phone or tablet.

Figure 12:
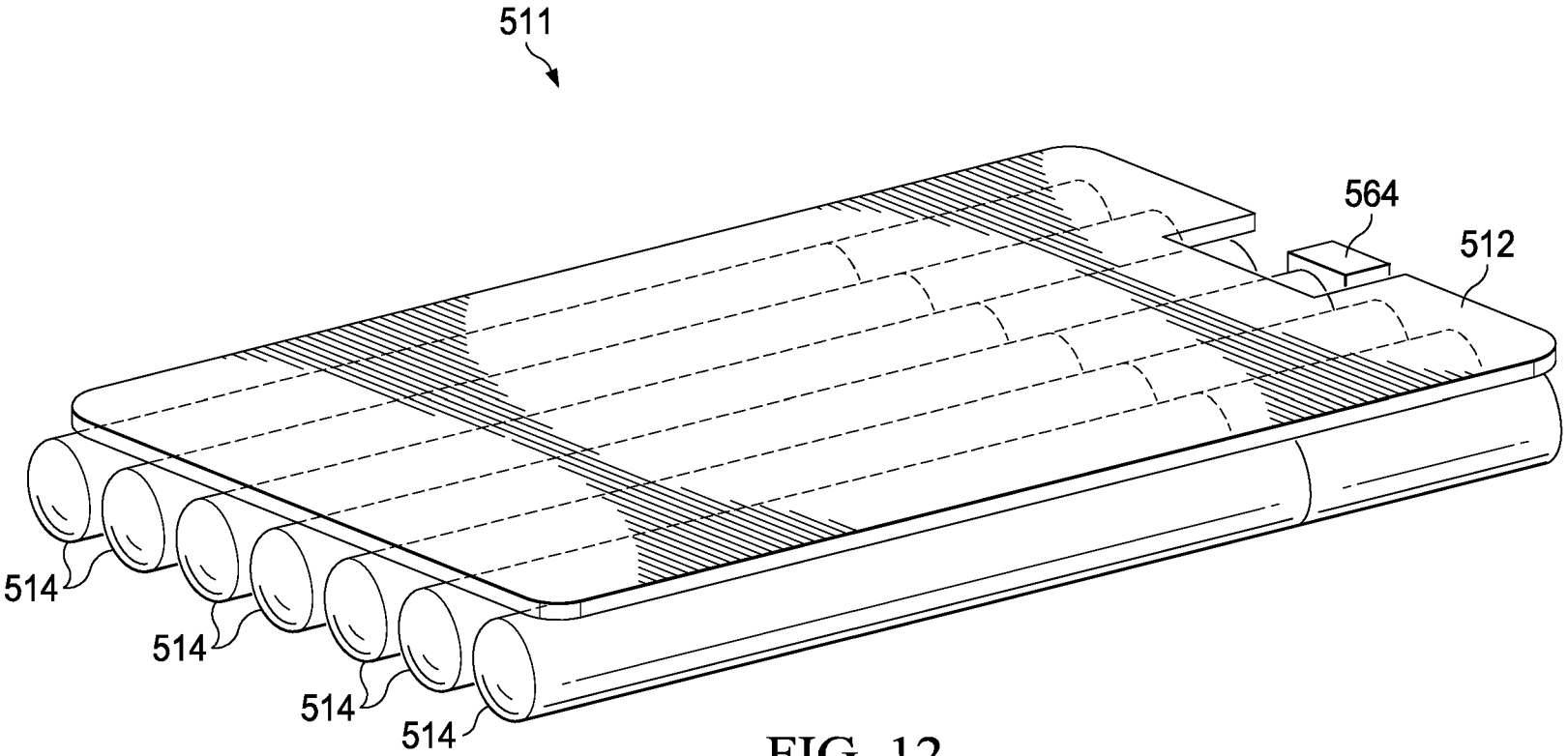
FIG. 12 depicts a perspective view of a dock system having a plurality of pontoons according to one embodiment.

Referring to FIG. 12, one embodiment of a dock system 511 is shown having a plurality of pontoons 514 that can support a platform 512. The pontoons 514 can include any suitable mechanism for raising or lowering the pontoons 514 and the associated platform 512. A pump 564 can be coupled to the pontoon 514 in accordance with versions described herein to selectively fill or drain one or more of the pontoons 514. For example, during transportation it may be desirable for a dock or platform to sit as far above the waterline as possible, particularly in shallow locations. Upon arrival at a suitable location the pontoons 514 can be filled using the pump 564 such that the dock system 511 is substantially beached and secured. When the dock system 511 is no longer needed the pump 564 can be used to draw water out of the pontoons 514 such that they can be transported once again. Such dock systems may be particularly useful for temporary and/or shallow dock applications or where it's impractical or undesirable for stakes or supports to be inserted into the lake, river, or water bed. It will be appreciated that any suitable dock systems 511 can be coupled together using any suitable mechanism. It will be appreciated that the pump 564 can be selectively removable such that a single pump can be used to fill or drain a number of associated dock sections.

It will be appreciated that the dock system 511 can also be used as a landing platform for personal watercraft, boats, or the like. For example, the dock system 511 can be filled with water to create a low enough profile that a watercraft can move onto the platform 512, which can be in the form of a ramp (not shown) or otherwise include boat docking features. Once the watercraft is positioned the pontoons 514 can be emptied to raise the dock system 511 and secure the watercraft on the platform 512.

Figure 13:
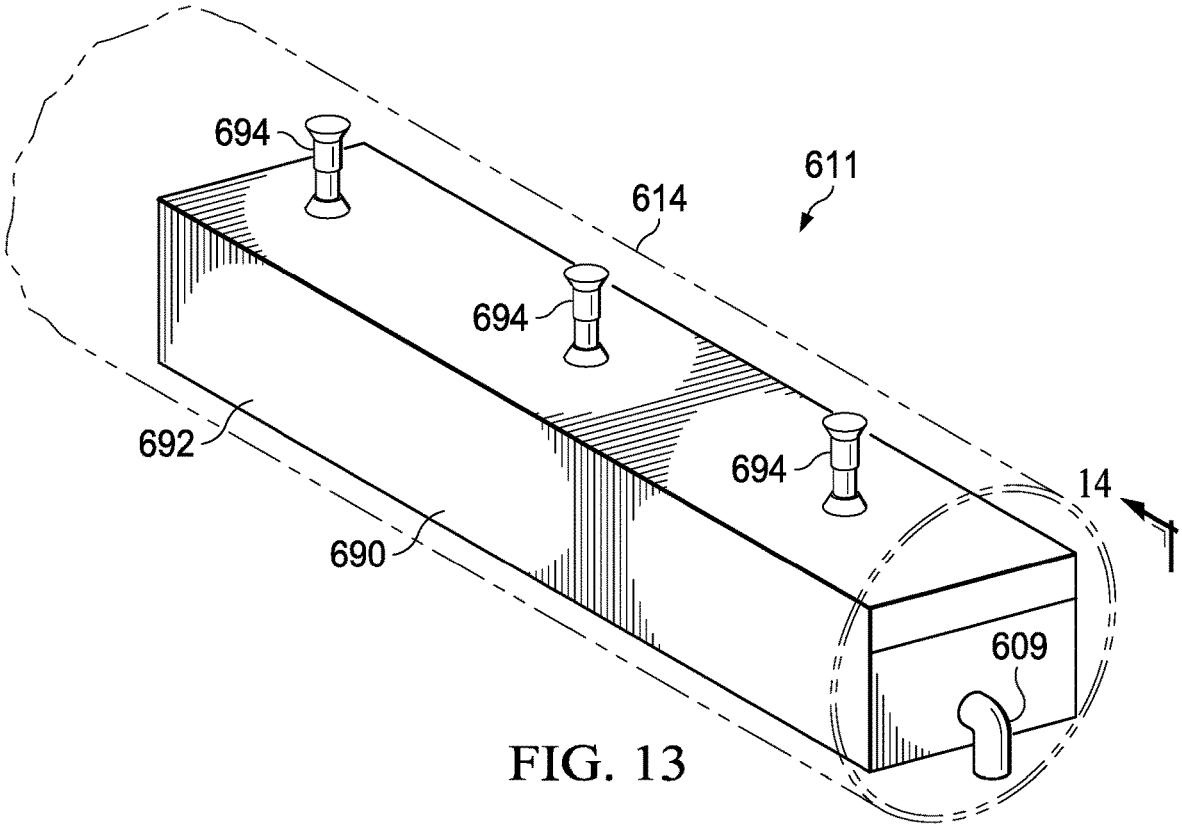
FIG. 13 depicts a perspective cutaway view of a retrofit pontoon assembly according to one embodiment.
Figure 14:
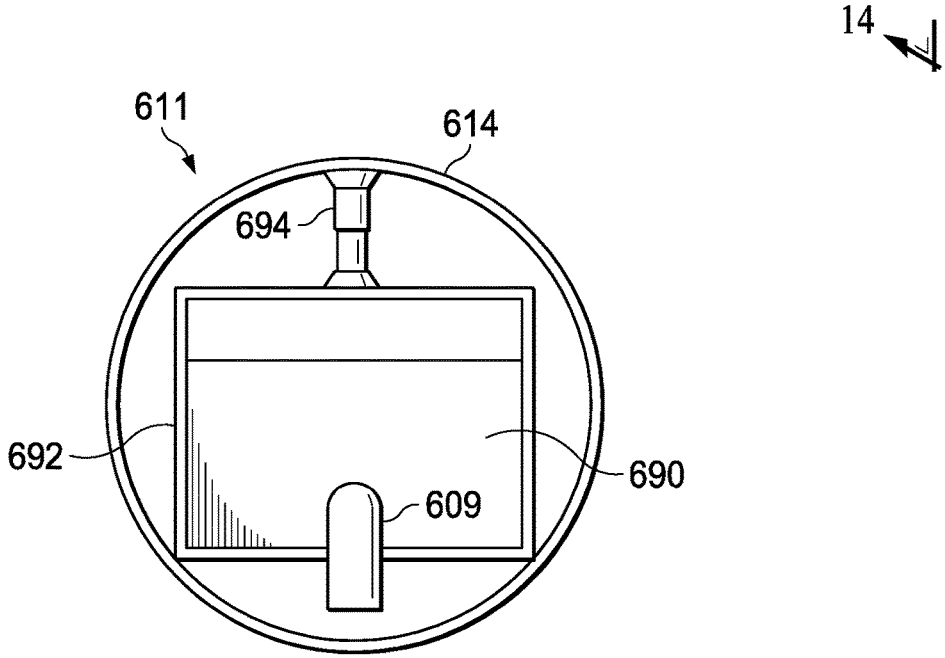
FIG. 14 depicts a front view of the retrofit pontoon assembly shown in FIG. 13.

Referring to FIGS. 13 and 14, one version of a pontoon retrofit system 611 is shown including a pontoon 614 and a retrofit assembly 690 that can be positioned within the pontoon 614. In one embodiment, the pontoon 614 can be a standard pontoon that is hollowed out so that the retrofit assembly 690 can be inserted into the pontoon 614. The retrofit assembly 690 can include a body 692 that can include one or a plurality of fillable chambers (not shown) that can be selective filled via an inlet/outlet tube 609. The body 692 can be cylindrical to match the general shape of a pontoon or, in the embodiment shown in FIGS. 13 and 14, the body 692 can be a rectangular box that can fit universally into a wide range of pontoons. The body 692 can be associated with one or a plurality of spacers 694 that can engage the body 692 and the pontoon 614 to permanently or selectively secure the retrofit assembly 690 to the pontoon 614. It will be appreciated that any suitable shape or configuration of a retrofit assembly is contemplated including any suitable attached or sizing features or elements. The retrofit assembly 690 can include a pump (not shown) and can be operated in accordance with versions described herein.

Figure 15:
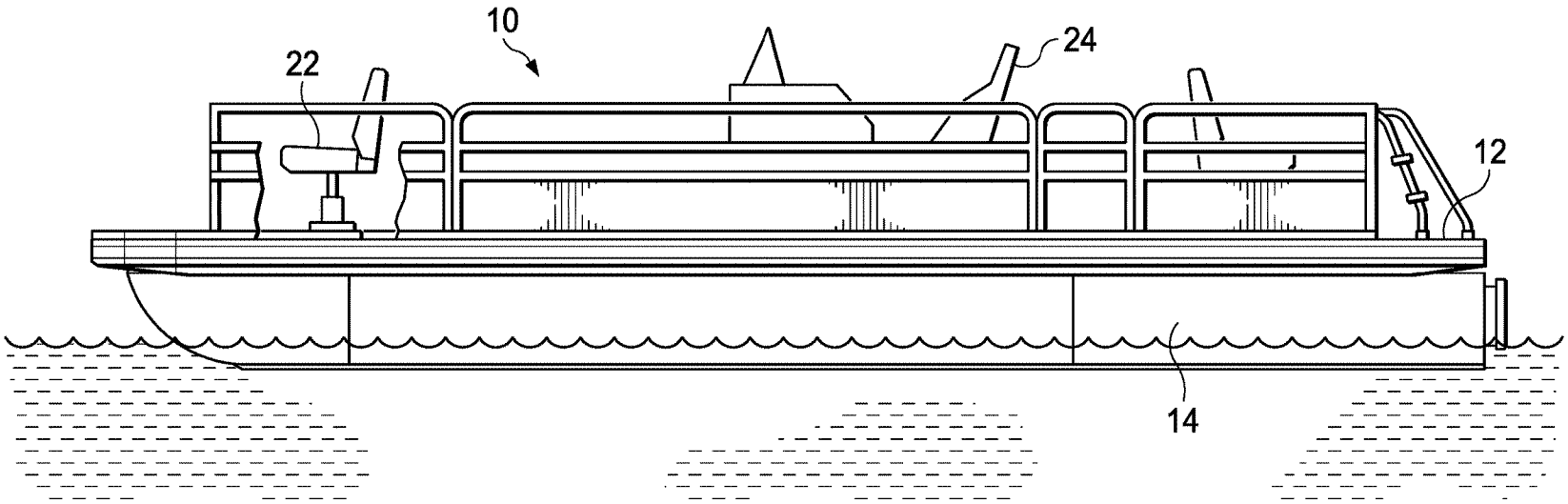
FIG. 15 depicts a right side view of a pontoon boat shown having a high profile relative to the waterline.
Figure 16:
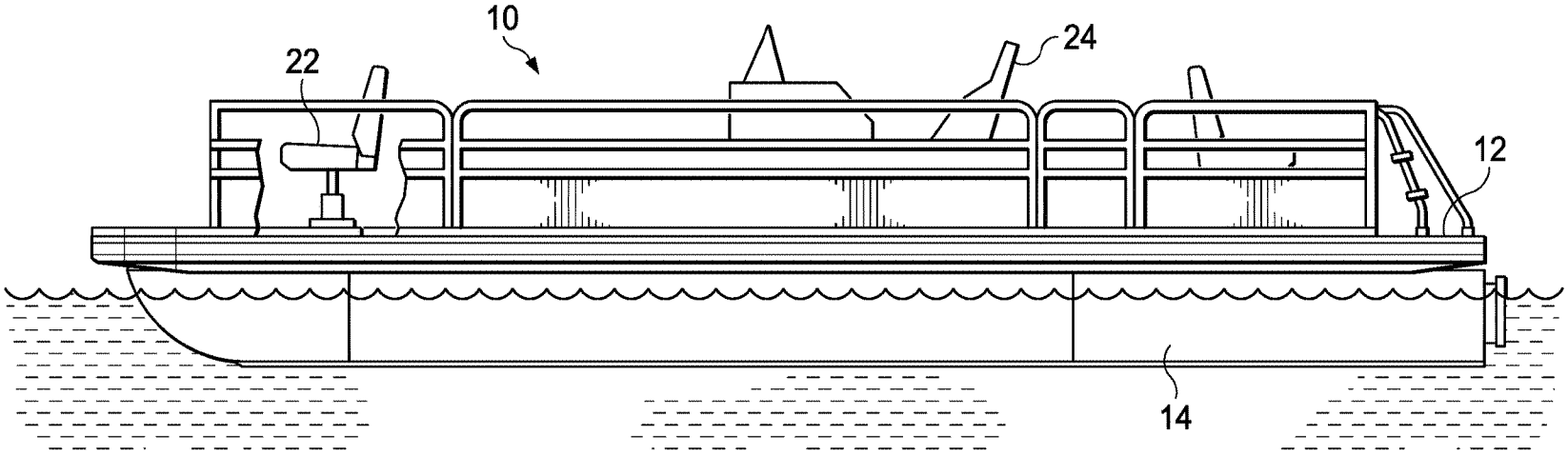
FIG. 16 depicts a right side view of a pontoon boat shown having a low profile relative to the waterline.
Figure 17:
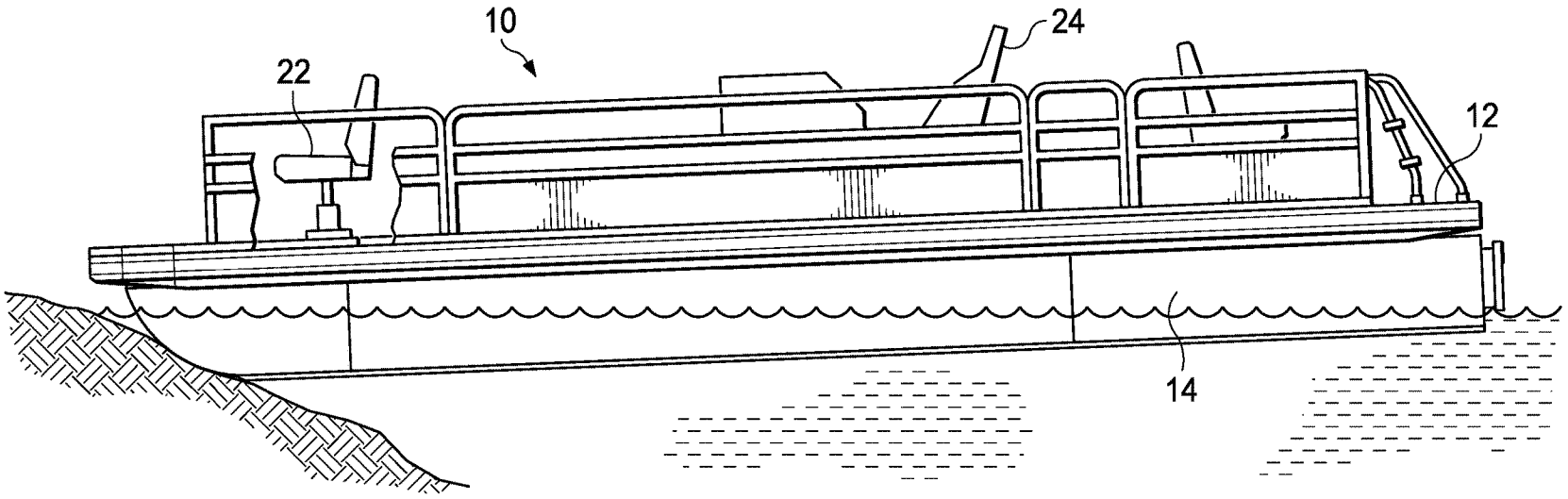
FIG. 17 depicts a right side view of a pontoon boat shown having a low profile bow and high profile stern such that the boat is substantially beached.
Figure 18:
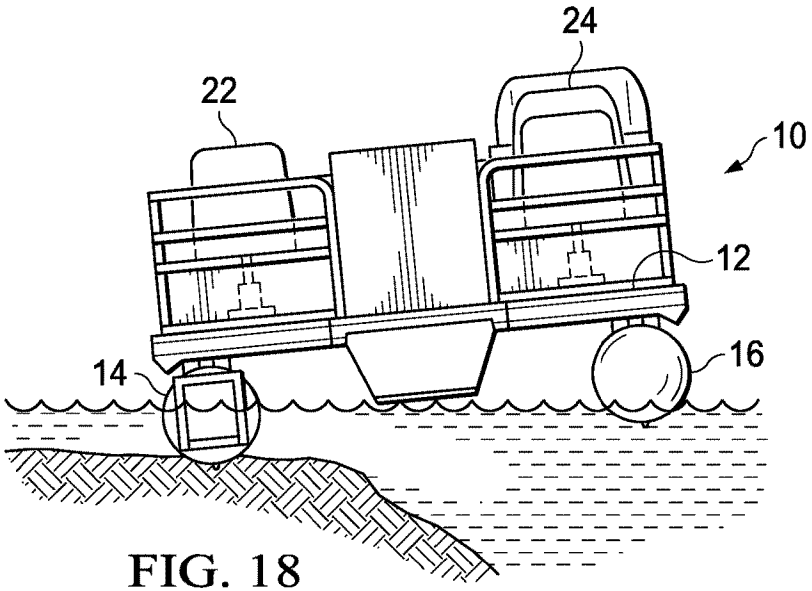
FIG. 18 depicts a rear view of a pontoon boat shown having a first pontoon with a low profile and a second pontoon with a high profile such that the boat is substantially beached in a "parallel parking" configuration.

Referring to FIGS. 15-18, a number of different fill or boat profiles are shown by way of example. FIG. 15 illustrates one version of a pontoon boat 10 where the pontoons may be substantially empty such that the pontoon boat 10 has a substantially high profile relative to the waterline. FIG. 16 illustrates a version of the pontoon boat 10 where the pontoons may be substantially filled such that the pontoon boat 10 has a substantially low profile relative to the waterline. FIG. 17 illustrates one version of a pontoon boat 10 where the pontoons may be substantially filled at the bow, but are substantially empty in the stern. Such a configuration may be useful for beaching the bow of the pontoon boat 10 for recreation or the like. FIG. 18 illustrates one version of a pontoon boat 10 where pontoon 14 is substantially filled and pontoon 16 is substantially empty. In the illustrated configuration the pontoon boat 10 may be "parallel parked" on a sandbar or the like, for example. In embodiment, the bow of the boat 10 can be emptied and the stern can be filled with water to raise the bow in the water. Such a configuration may facilitate boat trailering. A lower profile in the water may also be used when docking the boat 10 to allow for disable passengers, or those having trouble with height variations, to easily ingress and egress from the boat.

Figure 19:
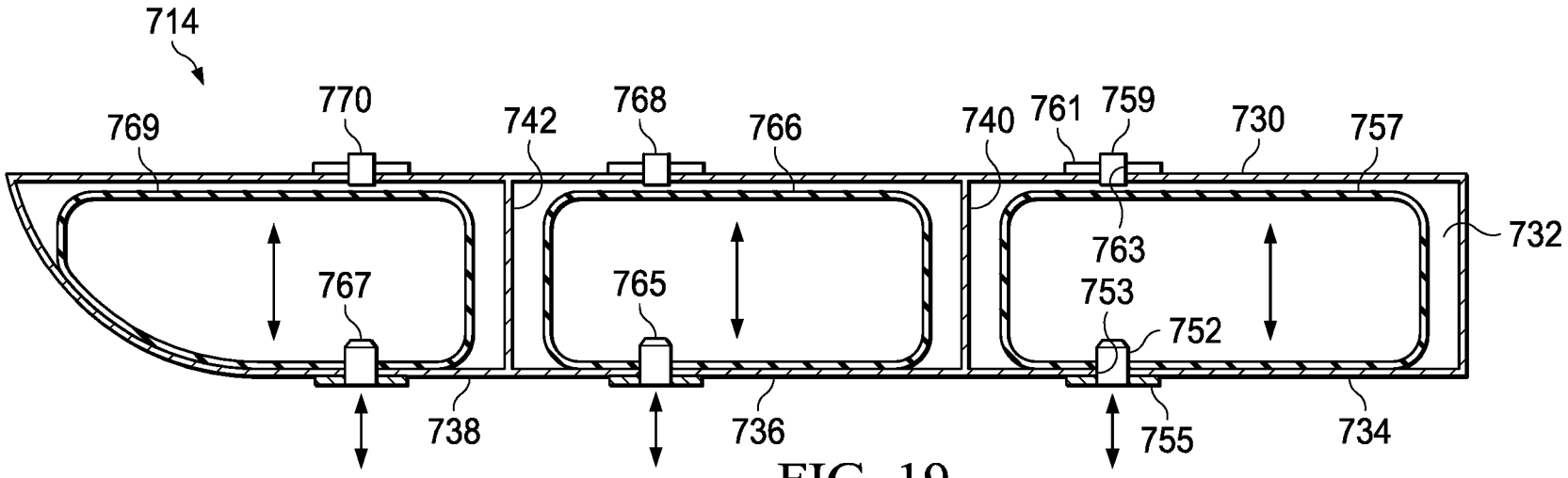
FIG. 19 depicts a right side cross-sectional view of a pontoon according to one embodiment.

Referring to FIG. 19, shown is a cross-sectional view of a pontoon 714 according to one embodiment. In the illustrated example, the pontoon 714 can include a substantially bullet-shaped or cigar-shaped pontoon body 730. The pontoon body 730 can be configured from aluminum and can define an internal cavity 732. The pontoon 714 can be divided into a first section 734, a second section 736, and a third section 738 by a first bulkhead 740 and a second bulkhead 742. The bulkheads 740, 742 can be constructed from aluminum and can be welded or otherwise coupled with the pontoon body 730 to form a watertight seal. The first bulkhead 740 and the second bulkhead 742 can substantially separate first section 734, second section 736, and third section 738 such that fluid can only fill or drain from the sections via dedicated tubing or pumps, for example, in accordance with versions described herein. It will be appreciated that in certain embodiments, particularly embodiments with relatively small pontoons, an upper section may be provided in the pontoon that is not fillable.

Still referring to FIG. 19, in one embodiment the pontoon 714 can include a first pump 752 that can extend into the first section 734 through an aperture 753 defined by the pontoon body 730. The first pump 752 can be coupled with a first plate 755 that can be fixedly attached to the pontoon body 730 in a watertight fashion, such as with rivets or the like. The first plate 755 can include a seal (not shown) or other suitable feature to facilitate a watertight coupling. The first pump 752 can include an impeller (not shown) or any other suitable mechanism that can draw water into a compliant, semi-compliant, or non-compliant first container 757 such that the first section 734 can be selectively filled with water. In one embodiment, the first container 757 can be flexible and sufficiently compliant such that the first container can substantially fill the cavity defined by the first section 734 including non-uniform geometries. When the first container 757 is partially or wholly filled the buoyancy of the pontoon 714 can be impacted to create a desired profile in the water. The pump 752 can be bi-directional such that the first pump 752 can selectively urge water out of the first container. The pump 752 can be electrically wired into the dashboard of the pontoon boat, can have an independent power source, can be remotely controlled such as via Bluetooth or the like, or can have any other suitable power or control configuration.

The pontoon 714 can also include a first release valve 759 that can extend into the first section 734 through an aperture 763 defined by the pontoon body 730. The first release valve 759 can be coupled with first valve plate 761 that can be fixedly attached to the pontoon body 730 in a watertight fashion, such as with rivets or the like. The first release valve 759 can be associated with the cavity 732 such that as the first container 757 is filled air can be released through the first release valve to accommodate the expansion of the first container 757. The first release valve 759 can be positioned at or about the top of the pontoon body 730 above the waterline. The first release valve 759 can be a two-way valve, a door, or any other feature that can allow for the first container 757 to fill and empty. The first release valve 759 can be a passive valve or can be powered and/or controllable as desired.

In one embodiment, the first pump 752 and the first release valve 759 can be part of a retrofit system for use with existing pontoons. For example, during installation the aperture 753 can be formed in the body 730 of an existing pontoon 714. The aperture 763 can also be formed in the body 730 using any suitable mechanism, cutter, drill, or the like. The first container 757 coupled with the pump 752 can be inserted through the aperture 753 into the cavity 752 and the pump 752 can then substantially seal the aperture 753 with or without the use of a first plate 755. The first release valve 759 can be inserted into the aperture 763 and can be sealed with or without the use of the first valve plate 761. A permanent retrofit system can be wired into the pontoon boat. A selectively removable system may include an independent power source for the pump and may be remotely controllable, for example. It will be appreciated that if the system is removed from the pontoon 714 that a permanent or selectively removable plug (not shown) can be inserted into the aperture 753 to prevent leakage.

The pontoon 714 can include any suitable number of pumps, valves, containers, or the like. For example, the second section 736 can be associated with a second pump 765 coupled with a second fillable container 766. A second release valve 768 can be coupled with the second section 736. The third section 738 can be associated with a third pump 767 coupled with a third fillable container 769. A third release valve 770 can be coupled with the third section 738. In one embodiment, each of the pumps 752, 765, 767 can be independently operated such that the associated containers 757, 766, 769 can be filled or drained to a desirable level. Adjusting the water level in each of the containers can correspondingly adjust the position of the pontoon boat on the water. FIG. 19 illustrates one example showing a pontoon with three separate sections, but it will be appreciated that any suitable number of sections such as one section, two sections, three sections, four sections, five sections, or more is contemplated. The containers 757, 766, 769 can have a uniform size and shape or can vary depending on their position, geometry of the pontoon, or the like. A one-size-fits-all container is contemplated that can be expandable, for example, to accommodate variety of pontoon dimensions. The containers can incorporate an algae or bacteria resistant material. The containers can be fixedly or selectively adhered inside the cavity 732 of the pontoon or, alternatively, can simply be passively retained within the cavity 732. The pumps 752, 765, 767 can be any suitable pump that can have a first fill mode and a second drain mode, for example.

Figure 20:
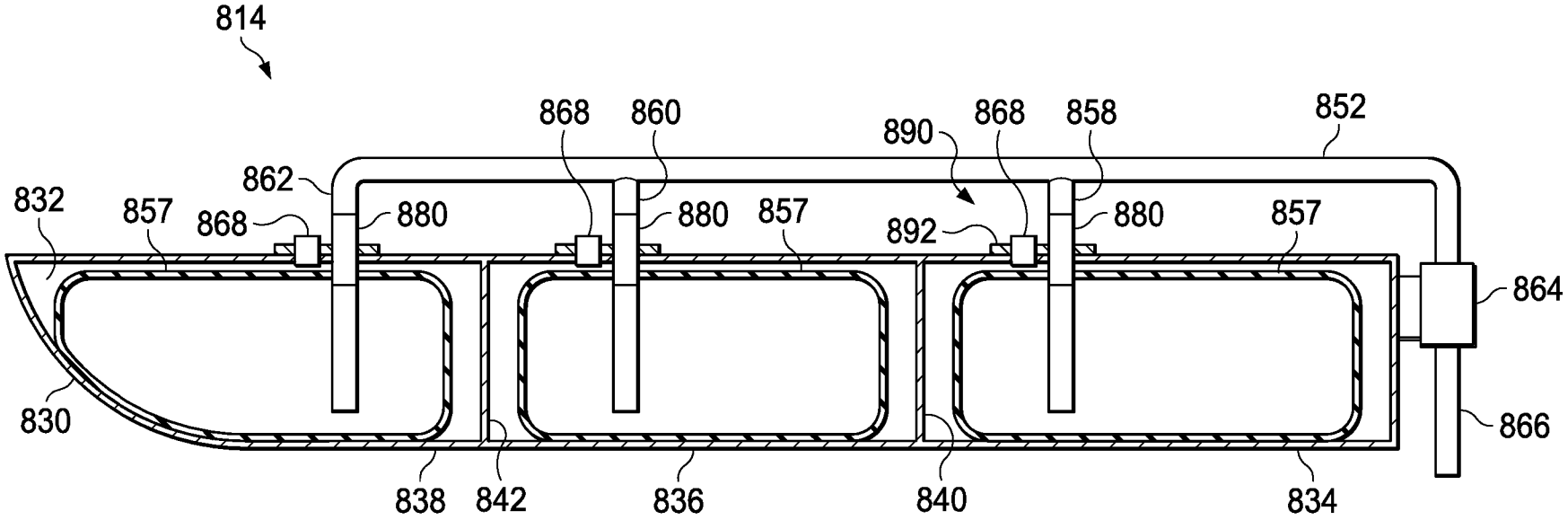
FIG. 20 depicts a right side cross-sectional view of a pontoon according to one embodiment.

Referring to FIG. 20, a cross-sectional view is shown taken along a pontoon 814 according to one embodiment. In the illustrated example, the pontoon 814 can include a substantially bullet-shaped or cigar-shaped pontoon body 830. The pontoon body 30 can be configured from aluminum and can define an internal cavity 832. The pontoon 814 can be divided into a first section 834, a second section 836, and a third section 838 by a first bulkhead 840 and a second bulkhead 842. The bulkheads 840, 842 can be constructed from aluminum and can be welded or otherwise coupled with the pontoon body 830 to form a watertight seal. The first bulkhead 840 and the second bulkhead 842 can substantially separate the first section 834, second section 836, and third section 838 such that fluid can only fill or drain from the sections via dedicated tubing in accordance with versions described herein.

Still referring to FIG. 8A, in one embodiment the pontoon 814 can include a pipe or main tube 852 that can extend substantially horizontally along the first section 834, the second section 836, and the third section 838. The main tube 852 can pass externally to the pontoon 814 as shown or, in an alternate embodiment, can be positioned internally. In one embodiment, the main tube 852 can be constructed from PVC and can have a diameter of about 1 inch. The main tube 852 can include a first lateral tube 858, a second lateral tube 860, and a third lateral tube 862 that can be associated with the first section 834, the second section 836, and the third section 838, respectively. The lateral tubes 858, 860, 862 can branch off of the main tube 852 into each respective section such that fluid can be selectively added or removed from each section 834, 836, 838 during operation. A container 857 can be associated with each of the lateral tubes and can be fluidly coupled with each of the lateral tubes 858, 860, 862 such that water passing through the lateral tubes will fill the containers and water exiting the lateral tubes will empty the containers. It will be appreciated that the lateral tubes 858, 860, 862 can extend any length, but in one embodiment are sufficiently long or otherwise configured to drain water that may pool in the bottom of each container.

The pontoon 814 can include a pump 864 that can be coupled to the rear end of the pontoon 814, for example. The pump 864 can be any suitable pump that can have a first fill mode and a second drain mode, for example. The pump 864 can be coupled with an inlet/outlet tube 866 that can be sized and positioned to remain in the water throughout the operation of the pump 864. The pump 864 can draw water with an impeller (not shown) through the inlet/outlet tube 866 and can urge the water through the main tube 852 and the associated lateral tubes 858, 860, 862 such that the water begins to fill the containers 857 in each of sections 834, 836, and 838 of the pontoon 814. In the drain mode, the pump 864 can reverse direction of the impeller and can draw water through the lateral tubes 858, 860, and 862 into the main tube 852 such that the water can be expelled through the inlet/outline tube 866. The pump 864 can be controlled manually or, alternatively, can be controlled by the controller 50 described elsewhere herein. The pump 864 may be battery operated, solar powered, or have any other suitable power source. It will be appreciated that as water or fluid is added to the pontoon 814 the pontoon boat can sink lower into the water and as water or fluid is removed from the pontoon 814 the pontoon boat can rise higher in the water. During operation an operator can manually operate the pump 864 until the desirable depth is set or, alternatively, the controller 50 can guide the pump 864 to fill the pontoon 814 to a specific or pre-set level.

In an alternate embodiment, the lateral tubes 58, 60, 62 can include valves 880 that can be opened and closed manually, with a controller 50, via wiring to the dashboard 26 (FIG. 1), or the like. In this embodiment the fluid or water may be pumped through the main tube 852, but valves 880 associated with certain sections may be opened and/or closed depending upon the desired profile. Such a configuration may allow one or more sections 834, 836, 838 to be selectively filled to adjust the position of the boat in the water on two or three axes. For example, referring to FIG. 1, a coordinate system is showing having X, Y, and Z axes. The pontoon boat 10 can, for example, rotate at the origin above the X axes, Y axes, and/or Z axis until a desirable position in the water is achieved.

In one embodiment, the pontoon 814 can include one or a plurality of ports 868 or valves that can be used passively or selectively release air pressure that may build up within the cavity 832 when the containers 857 are filled. Additional or alternatively, the ports 868 can be used for the delivery of fluid, chemicals, cleaners, or the like into the internal cavity 832 of the pontoon body 830. For example, if lake water is being used to selectively fill the pontoon 814 then algae or other biological material may begin to grow within the pontoon body 830. One or more ports 868 may provide access to the internal cavity 832 for the delivery of biocide, algaecide, pesticide, or cleaning materials. The port 68 can allow for a hose (not shown) to be inserted into the body cavity 832 to deliver or remove fluid as desirable.

In one embodiment, the selective fill system described with respect to FIG. 20 can be a retrofit system. During installation, a traditional pontoon 814 can be used where holes or apertures can be bored into the sections 834, 836, 838. Into each of these apertures an assembly 890 including features such as, for example, lateral tube 858, port 868, valve 880, and container 880, can be placed. Such an assembly 890 can include a plate 892 that can retain some or all of the elements associated with the assembly 890. The plate 892 can be permanently or selectively affixed to the body 830 of the pontoon 814. Such an assembly 890 may allow for a pontoon 814 to be relatively quickly retrofit to add the functionality as described herein. Such an assembly 890 may also have the benefit of creating a single aperture to access the pontoon, where the aperture is above the waterline to reduce the chance for leakage. It will also be appreciated that such a system can be incorporated into any suitable pontoon at the time of manufacture. It will be appreciated that the plates and/or other structures associated with pumps, valves, or the like can be flush with the body of the pontoon, recessed, or otherwise configured to diminish the impact on fluid flow when the boat is in operation.

In general, it will be apparent to one of ordinary skill in the art that at least some of the embodiments described herein can be implemented in many different embodiments of software, firmware, and/or hardware. The software code or specialized control hardware that can be used to implement embodiments is not limiting. For example, embodiments described herein can be implemented in computer software using any suitable computer software language type, using, for example, conventional or object-oriented techniques. Such software can be stored on any type of suitable computer-readable medium or media, such as, for example, a magnetic or optical storage medium. The operation and behavior of the embodiments can be described without specific reference to specific software code or specialized hardware components. The absence of such specific references is feasible, because it is clearly understood that artisans of ordinary skill would be able to design software and control hardware to implement the embodiments based on the present description with no more than reasonable effort and without undue experimentation.

Moreover, the processes described herein can be executed by programmable equipment, such as computers or computer systems and/or processors. Software that can cause programmable equipment to execute processes can be stored in any storage device, such as, for example, a computer system (nonvolatile) memory, an optical disk, magnetic tape, or magnetic disk. Furthermore, at least some of the processes can be programmed when the computer system is manufactured or stored on various types of computer-readable media.

It can also be appreciated that certain portions of the processes described herein can be performed using instructions stored on a computer-readable medium or media that direct a computer system to perform the process steps. A computer-readable medium can include, for example, memory devices such as diskettes, compact discs (CDs), digital versatile discs (DVDs), optical disk drives, or hard disk drives. A computer-readable medium can also include memory storage that is physical, virtual, permanent, temporary, semi-permanent, and/or semi-temporary.

A "controller", can be, for example and without limitation, a computer, a computer system, a host, a server, a processor, a microcomputer, a minicomputer, a server, a mainframe, a laptop, a personal data assistant (PDA), a wireless e-mail device, a cellular phone, a pager, a fax machine, a scanner, or any other programmable device configured to transmit and/or receive data over a network. Computer systems and computer-based devices disclosed herein can include memory for storing certain software modules used in obtaining, processing, and communicating information. It can be appreciated that such memory can be internal or external with respect to operation of the disclosed embodiments. The memory can also include any means for storing software, including a hard disk, an optical disk, floppy disk, ROM (read only memory), RAM (random access memory), PROM (programmable ROM), EEPROM (electrically erasable PROM) and/or other computer-readable media. Non-transitory computer-readable media, as used herein, comprises all computer-readable media except for a transitory, propagating signal.

In various embodiments disclosed herein, a single component can be replaced by multiple components and multiple components can be replaced by a single component to perform a given function or functions. Except where such substitution would not be operative, such substitution is within the intended scope of the embodiments.

The foregoing description of embodiments and examples has been presented for purposes of illustration and description. It is not intended to be exhaustive or limiting to the forms described. Numerous modifications are possible in light of the above teachings. Some of those modifications have been discussed, and others will be understood by those skilled in the art. The embodiments were chosen and described in order to best illustrate principles of various embodiments as are suited to particular uses contemplated. The scope is, of course, not limited to the examples set forth herein, but can be employed in any number of applications and equivalent devices by those of ordinary skill in the art. Rather it is hereby intended the scope of the invention to be defined by the claims appended hereto.

What is claimed is:

1. A retrofit pontoon system comprising:

a pontoon, the pontoon having a pontoon body defining a first cavity, the pontoon body having a first aperture;

a retrofit assembly, the retrofit assembly including a selectively fillable container sized to pass through the first aperture; and wherein filling the selectively fillable container lowers a profile of the pontoon in water and emptying the selectively fillable container raises the profile of the pontoon in the water.

2. The retrofit pontoon system of claim 1, wherein the retrofit assembly further comprises a plate for securing the retrofit assembly to the pontoon body.

3. The retrofit pontoon system of claim 1, wherein the retrofit assembly further comprises a first release valve.

4. The retrofit pontoon system of claim 1, wherein the retrofit assembly further comprises a first port such that air in the first cavity is released when the selectively fillable container expands.

5. The retrofit pontoon system of claim 1, wherein the selectively fillable container is a compliant balloon.

6. The retrofit pontoon system of claim 1, wherein the selectively fillable container is a non-compliant balloon.

7. The retrofit pontoon system of claim 1, further comprising a pump operably coupled to the selectively fillable container, wherein the pump includes an impeller.

8. The retrofit pontoon system of claim 1, further comprising a plurality of retrofit assemblies associated with a plurality of pontoon sections.

9. The retrofit pontoon system of claim 8, further comprising a pump operably coupled to the selectively fillable container, wherein the plurality of retrofit assemblies are coupled with the pump.

10. The retrofit pontoon system of claim 9, wherein the pump is controlled with a controller.

11. A method for retrofitting a pontoon using a retrofit assembly, the pontoon having a pontoon body defining a first cavity, the pontoon body having a first aperture, the retrofit assembly including a selectively fillable container sized to pass through the first aperture, the method comprising:

inserting the selectively fillable container through the first aperture into the first cavity of the pontoon body; and selectively filling and draining water from the selectively fillable container, wherein filling the selectively fillable container lowers a profile of the pontoon in the water and emptying the selectively fillable container raises the profile of the pontoon in the water.

12. The method of claim 11, wherein the retrofit assembly further comprises a plate for securing the retrofit assembly to the pontoon body.

13. The method of claim 11, wherein the retrofit assembly further comprises a first release valve.

14. The method of claim 11, wherein the retrofit assembly further comprises a first port such that air in the first cavity is released when the selectively fillable container expands.

15. The method of claim 11, wherein the selectively fillable container is a compliant balloon.

16. The method of claim 11, wherein the selectively fillable container is a non-compliant balloon.

17. The method of claim 11, wherein the retrofit assembly further comprises a pump operably coupled to the selectively fillable container, wherein the pump includes an impeller.

18. The method of claim 11, further comprising a plurality of retrofit assemblies associated with a plurality of pontoon sections.

19. The method of claim 18, wherein the retrofit assembly further comprises a pump operably coupled to the selectively fillable container, wherein the plurality of retrofit assemblies are coupled with the pump.

20. The method of claim 19, wherein the pump is controlled with a controller.

* * * * *